US007695577B2

(12) United States Patent
Shioda et al.

(10) Patent No.: US 7,695,577 B2
(45) Date of Patent: Apr. 13, 2010

(54) ALUMINUM ALLOY EXCELLENT IN WEAR RESISTANCE AND SLIDING MEMBER USING THIS ALLOY

(75) Inventors: Masahiko Shioda, Tokyo (JP); Sanji Kitaoka, Tokyo (JP); Yukio Kuramasu, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 0 days.

(21) Appl. No.: 11/524,898

(22) Filed: Sep. 22, 2006

(65) Prior Publication Data

US 2007/0068604 A1 Mar. 29, 2007

Related U.S. Application Data

(63) Continuation of application No. PCT/JP2005/005226, filed on Mar. 23, 2005.

(30) Foreign Application Priority Data

Mar. 23, 2004 (JP) ..... 2004-084259

(51) Int. Cl.
*C22C 21/04* (2006.01)

(52) U.S. Cl. ..... 148/417; 420/535; 420/548

(58) Field of Classification Search ..... 148/417; 420/535, 548, 549
See application file for complete search history.

(56) References Cited

U.S. PATENT DOCUMENTS

| | | | |
|---|---|---|---|
| 4,556,533 | A | 12/1985 | Oaku et al. |
| 5,104,444 | A | 4/1992 | Shioda et al. |
| 5,174,955 | A | 12/1992 | Shioda et al. |
| 5,582,659 | A | 12/1996 | Hashimoto et al. |
| 5,762,728 | A | 6/1998 | Kuramasu et al. |
| 5,912,073 | A | 6/1999 | Shioda et al. |
| 2002/0088512 | A1 | 7/2002 | Kitaoka et al. |
| 2003/0136477 | A1 | 7/2003 | Kitaoka et al. |
| 2003/0143101 | A1 | 7/2003 | Kitaoka et al. |

FOREIGN PATENT DOCUMENTS

| | | | | |
|---|---|---|---|---|
| DE | 38 23 476 | A1 | | 1/1989 |
| EP | 0 005 910 | A1 | | 12/1979 |
| EP | 0 672 760 | A1 | | 9/1995 |
| JP | 60190542 | A | * | 9/1985 |
| JP | 1-298131 | | | 7/1989 |
| JP | 5-78770 | | | 3/1993 |
| JP | 7-90459 | | | 4/1995 |
| JP | 7-252567 | | | 10/1995 |
| JP | 10-298690 | | | 11/1998 |
| JP | 2000-204428 | | | 7/2000 |
| JP | 2000204428 | A | * | 7/2000 |
| JP | 2000355722 | A | * | 12/2000 |
| WO | WO 2005/059195 | A1 | | 6/2005 |
| WO | WO 2005090625 | A1 | * | 9/2005 |

* cited by examiner

*Primary Examiner*—Roy King
*Assistant Examiner*—Janelle Morillo
(74) *Attorney, Agent, or Firm*—Oblon, Spivak, McClelland, Maier & Neustadt, L.L.P.

(57) ABSTRACT

The present invention discloses an aluminum alloy being excellent in wear resistance, containing, in mass %, 12.0 to 13.7% of Si, 2.0 to 5.0% of Cu, 0.1 to 1.0% of Mg, 0.8 to 1.3% of Mn, 0.10 to 0.5% of Cr, 0.05 to 0.20% of Ti, 0.5 to 1.3% of Fe, 0.003 to 0.02% of P, and has a Ca content controlled to less than 0.005 mass %, the balance being Al and inevitable impurities; and an aluminum alloy sliding member excellent in wear resistance, which has in mass %, 12.0 to 14.0% of Si, 2.0 to 5.0% of Cu, 0.1 to 1.0% of Mg, 0.8 to 1.3% of Mn, 0.10 to 0.5% of Cr, 0.05 to 0.20% of Ti, 0.5 to 1.3% of Fe, 0.003 to 0.02% of P, and has a Ca content controlled to less than 0.005 mass %, the balance being Al and inevitable impurities, and contains primary crystals of Si having a grain diameter of 20 μm or more in an amount of 20 pieces/$mm^2$ or less. The alloy may contain one or two of 0.0001 to 0.01 mass % of B, and 0.3 to 3.0 mass % of Ni.

3 Claims, No Drawings

ALUMINUM ALLOY EXCELLENT IN WEAR RESISTANCE AND SLIDING MEMBER USING THIS ALLOY

CROSS-REFERENCE TO RELATED APPLICATIONS

The present application is an application under 35 U.S.C.§111(a) and 37 CFR §1.53(b) based on the International Application PCT/JP2005/005226, entitled "ALUMINUM ALLOY EXCELLENT IN WEAR RESISTANCE AND SLIDING MEMBER USING THE SAME," filed Mar. 23, 2005, which was filed claiming priority to Japanese patent application No. 2004-084259 filed Mar. 23, 2004, all of which are hereby incorporated by reference in their entirety.

TECHNICAL FIELD

The present invention relates to an aluminum alloy excelling in wear resistance and a sliding member using this alloy, in particular an aluminum alloy excelling in wear resistance and a sliding member using this alloy, capable of being used in frictional environments such as compressor parts and oil pump covers.

BACKGROUND

In recent years, there has been a strong demand to lighten the weights of vehicles in order to reduce energy consumption, and in order to meet this demand, cast aluminum alloys such as A390 have been used in the compressor parts and oil pump covers of vehicles. These aluminum alloys have been widely used in engines and other wear-resistant parts for excelling in wear resistance.

A390 aluminum alloy has a composition containing 16.0-18.0 mass % of Si, 4.0-5.0 mass % of Cu, 0.45-0.65 mass % of Mg, less than 0.5 mass % of Fe, less than 0.1 mass % of Mn and less than 0.20 mass % of Ti, and is characterized by the addition of large amounts of Si in order to achieve the necessary wear resistance.

However, as the Si content increases, the liquidus temperature of the aluminum alloy rises, thus requiring the aluminum alloy to be melted and cast at a higher temperature than is generally used. As a result, not only must an expensive lining refractory material be used, but there are various other drawbacks such as reduced furnace durability, increased fuel consumption and reduced durability of the casting dice. Additionally, there are problems such as the distribution of primary crystal Si becoming uneven, and casting defects such as voids.

Additionally, hyper-eutectic Al-Si alloys excelling in wear resistance and burn resistance such as die-cast alloy JIS ADC14 are used in a manner similar to the above alloy. Furthermore, the applicant of the present application has also developed aluminum alloys such as those disclosed in JP-A H5-78770 and JP-A H7-252567 as wear-resistant alloys, and these have been patented as Japanese Patent No. 2709663 and Japanese Patent No.3378342.

Patent Document 1: JP-A H5-78770

Patent Document 2: JP-A H7-252567

The above patents are for a cast aluminum alloy excelling in wear resistance, characterized by comprising 14.0-16.0 wt % of Si, 2.0-5.0 wt % of Cu, 0.1-1.0 wt % of Mg, 0.3-0.8 wt % of Mn, 0.1-0.3 wt % of Cr, 0.05-0.20 wt % of Ti, 0.003-0.02 wt % of P, and 1.5 wt % or less of Fe, wherein the Ca content is limited to less than 0.005 wt % and having a uniform dispersion of primary crystal Si with an average grain size of 10-50 μm; and a cast aluminum alloy excelling in wear resistance, characterized by comprising 14.0-16.0 wt % of Si, 2.0-5.0 wt % of Cu, 0.1-1.0 wt % of Mg, 0.3-0.8 wt % of Mn, 0.1-0.3 wt % of Cr, 0.01-0.20 wt % of Ti, 0.003-0.02 wt % of P, and 1.5 wt % or less of Fe, wherein the Ca content is limited to 0.005 wt % or less, and primary crystal Si and Al—Si—Fe—Mn—Cr intermetallic compounds are both dispersed as crystals with a grain size of 5-30 μm.

DETAILED DESCRIPTION

While the above-mentioned alloys are all alloys that excel in wear resistance due to the dispersion of hard primary crystal Si, if the counterpart is too soft, the primary crystal Si dispersed in these hyper-eutectic Al—Si compounds can cause wear in the counterpart, in which case the surfaces of the counterpart must be made harder than primary crystal Si.

Similarly, the wear particles can become buried in the soft a phase of the hyper-eutectic Al—Si alloys and these can cause wear in the counterpart, in which case the counterpart must be made harder. Additionally, depending on the conditions, the amount of wear on machine tools during working can increase, thus reducing the durability of the machine tools.

Therefore, the present invention has the object of offering an aluminum alloy excelling in wear resistance and capable of reducing the wear on counterpart.

The aluminum alloy excelling in wear resistance according to the present invention is characterized by comprising 12.0-13.7 mass % of Si, 2.0-5.0 mass % of Cu, 0.1-1.0 mass % of Mg, 0.8-1.3 mass % of Mn, 0.10-0.5 mass % of Cr, 0.05-0.20 mass % of Ti, 0.5-1.3 mass % of Fe and 0.003-0.02 mass % of P, wherein the Ca content is limited to less than 0.005 mass %, and the remainder consists of Al and unavoidable impurities. The alloys may further comprise one or both of 0.0001-0.01 mass % of B and 0.3-3.0 mass % of Ni.

The present invention further offers a sliding member composed of an aluminum alloy excelling in wear resistance characterized by comprising 12.0-14.0 mass % of Si, 2.0-5.0 mass % of Cu, 0.1-1.0 mass % of Mg, 0.8-1.3 mass % of Mn, 0.10-0.5 mass % of Cr, 0.05-0.20 mass % of Ti, 0.5-1.3 mass % of Fe and 0.003-0.02 mass % of P, wherein the Ca content is limited to less than 0.005 mass %, the remainder consists of Al and unavoidable impurities, and there are less than 20/mm$^2$ of primary crystal Si grains with a grain size of at least 20 μm. This sliding member composed of an aluminum alloy may further comprise one or both of 0.0001-0.01 mass % of B and 0.3-3.0 mass % of Ni.

The aluminum alloy of the present invention excels in wear resistance and is capable of reducing the wear of counterpart. Additionally, an aluminum sliding member composed of this aluminum alloy has effects similar to those mentioned above.

Aluminum Alloy

The present inventors performed repeated evaluations and experiments concerning aluminum alloys, as a result of which they discovered that, in particular, primary crystal Si with a grain size of at least 20 μm causes wear in counterpart and increases the damage to machine tools. Upon furthering their research, they discovered that the wear on counterpart and the damage to machine tools can be suppressed by limiting the number of primary crystal Si grains with a grain size of at least 20 μm to 20/mm$^2$ or less. Furthermore, they discovered that by selecting intermetallic compounds whose crystallization initiation temperature differs from primary crystal Si, the crystals can be uniformly dispersed, and the finely dispersed crystals will finely fragment the soft a phase, thus preventing the occurrence of bulky a phases that are not conducive to improving the wear resistance.

The present invention was completed as an alloy design based on the above technical discoveries, and relates to an aluminum alloy capable of reducing the size of the Si dispersed on the sliding surface as compared with conventional hyper-eutectic Al—Si alloys, and refining the soft a phase.

Upon performing more research, they discovered that an aluminum alloy having the above-described properties can be obtained by an aluminum alloy comprising 12.0-13.7 mass % of Si, 2.0-5.0 mass % of Cu, 0.1-1.0 mass % of Mg, 0.8-1.3 mass % of Mn, 0.10-0.5 mass % of Cr, 0.05-0.20 mass % of Ti, 0.5-1.3 mass % of Fe and 0.003-0.02 mass % of P, wherein the Ca content is limited to less than 0.005 mass %, and the remainder consists of Al and unavoidable impurities.

Herebelow, the specific functions of each of the constituents shall be described.

(Si: 12.0-13.7 mass %)

Si is an element that improves the wear resistance of aluminum alloys. There is little primary crystal Si, if the amount of Si is less than 12.0 mass %, making the wear resistance insufficient, and if the amount exceeds 13.7 mass %, large amounts of coarse primary crystal Si are dispersed, and this can cause excessive wear on counterpart. Additionally, this coarsening can cause the distribution of primary crystal Si to become uneven, as a result of which the α phase cannot be finely fragmented and the soft a phase is coarsened, thus reducing the wear resistance. Furthermore, if the amount of primary crystal Si exceeds 13.7 mass %, the crystallization initiation temperature of the primary crystal Si and the crystallization initiation temperature of intermetallic compounds to be described below approach each other, so that these hard layers crystallize at the same location, as a result of which the hard layers are not uniformly dispersed, and the α phase also coarsens. Additionally, Si has the function of improving mechanical strength, casting ability, vibration prevention and low-temperature expansion.

(Cu: 2.0-5.0 mass %)

Cu has the function of strengthening the aluminum alloy matrix, thereby improving the wear resistance. In order to obtain this function, it is necessary to include at least 2.0 mass % of Cu, but if the Cu content exceeds 5.0 mass %, many voids are generated, thus reducing the corrosion resistance.

(Mg: 0.1-1.0 mass %)

Mg is an alloy element useful for raising the wear resistance and strength of aluminum alloys. While the above effects can be obtained by adding at least 0.1 mass % of Mg, 1.0 mass % should preferably not be exceeded, since coarse compounds can be formed, thus reducing toughness.

(Mn: 0.8-1.3 mass %; Cr: 0.10-0.5 mass %; Fe: 0.5-1.3 mass %)

Mn, Cr and Fe disperse as Al—Si—Fe—Mn—Cr intermetallic compounds, and improve the wear resistance as a hard phase. Additionally, the crystallization temperatures of these intermetallic compounds are far from the crystallization temperature of primary crystal Si, so they are dispersed finely and evenly in the structure. By finely and evenly dispersing, they finely divide the soft α phase, thus preventing coarsening. Furthermore, these compounds are not as hard as primary crystal Si, so they can reduce wear of counterpart.

However, if the amount of Mn, Cr and Fe exceeds the above ranges, a reduction in casting ability is observed. At the same time, the intermetallic compounds coarsen, thus reducing toughness. On the other hand, if less than the above ranges, the improvement in wear resistance is inadequate. Additionally, Fe and Mn have effects of preventing burning of alloy melt onto the mold.

(Ti: 0.05-0.20 mass %)

Ti is an element that refines the crystal grains of aluminum alloys, and has the effect of improving the mechanical properties. This effect becomes apparent upon exceeding 0.05 mass %, but the mechanical properties are conversely reduced upon exceeding 0.20 mass %.

(P: 0.003-0.02 mass %)

P forms a nucleus for primary crystal Si, and contributes to refinement and uniform dispersion of the primary crystals. While this effect can be obtained by adding at least 0.003 mass % of P, but P should not exceed 0.02 mass % because this reduces the fluidity and casting ability of the melt.

(Ca: Less than 0.005 mass %)

If Ca is contained by at least 0.005 mass %, the internal voids are enlarged during casting, thus reducing the casting ability. Additionally, the primary crystal Si refinement effect of P is inhibited.

(B: 0.0001-0.01 mass % and Ni: 0.3-3.0 mass %)

B and Ni which can be added as optional constituents have the function of further improving the mechanical properties of aluminum alloys. In particular, B and Ti both refine crystal grains, thus contributing to increases in strength and toughness. While these effects become apparent when at least 0.0001 mass % of B is contained, the toughness decreases if B exceeds 0.01 mass %. While Ni raises the high-temperature strength, at more than 3.0 mass %, it forms coarse compounds and reduces the ductility.

(Limit of Number of Primary Crystal Si with Grain Size of at Least 20 μm to 20/mm$^2$ or Less)

If the number of primary crystal Si with a grain size of at least 20 μm is greater than 20/mm$^2$, there is a tendency toward wear occurring on machine tools and counterpart. It is better to cast at high speed such as by a die-casting process in order to finely and evenly disperse the primary crystal Si.

Aluminum Alloy Sliding Member

The aluminum alloy sliding member in accordance with an embodiment of the present invention is composed of an aluminum alloy which has the same composition as mentioned above, except for the Si content which may range from 12.0-14.0 mass %.

EXAMPLES

Alloy ignots with the compositions of Examples 1-3 and Comparative Examples 1-5 shown in Table 1 were melted, then die-cast in a die-casting machine with a clamping force of about $3.5\times10^6$ N at 720° C. (high temperature for preventing aggregation of the added P) for Examples 1-3 and Comparative Examples 1, 4 and 5, and at 680° C. for Examples 2 and 3, to obtain plates 12 mm thick.

TABLE 1

| Constituents | | Chemical Composition of Aluminum Alloy (mass %) | | | | | | | | | | |
|---|---|---|---|---|---|---|---|---|---|---|---|---|
| | | Si | Cu | Mg | Mn | Cr | Ti | Fe | P | Ni | B | Al |
| Examples | 1 | 13.7 | 2.9 | 0.8 | 1.1 | 0.20 | 0.11 | 0.8 | 0.0075 | — | — | bal |
| | 2 | 12.6 | 3.0 | 0.8 | 1.2 | 0.20 | 0.12 | 0.9 | 0.0060 | 0.4 | — | bal |
| | 3 | 13.7 | 2.5 | 0.6 | 0.9 | 0.30 | 0.11 | 0.8 | 0.0075 | — | 0.002 | bal |
| Comparative Examples | 1 | 18.0 | 3.0 | 0.6 | 0.8 | 0.30 | 0.06 | 0.5 | 0.0080 | — | 0 | bal |
| | 2 | 10.5 | 3.2 | 0.3 | 0.4 | — | 0.01 | 0.8 | — | — | 0 | bal |
| | 3 | 13.7 | 2.9 | 0.8 | 1.4 | 0.20 | 0.10 | 0.8 | 0.0010 | — | 0 | bal |
| | 4 | 13.4 | 2.9 | 0.7 | 0.4 | 0.20 | 0.10 | 0.3 | 0.0075 | — | 0 | bal |
| | 5 | 12.6 | 3.0 | 0.8 | 0.8 | 0.05 | 0.10 | 0.1 | 0.0075 | — | 0 | bal |

Next, a 35×35×6 mm wear test piece was cut from each die-cast material. Each test piece was worked so that a surface 1.5 mm from the casting surface was the surface of the wear test.

Table 2 shows the average grain size of the primary crystal Si and number of primary crystal Si grains with a grain size of at least 20 μm in the wear test surface of each test piece. The grain sizes were measured by an image analysis device using optical microscope photographs observed at 1000× resolution.

TABLE 2

| Constituents | | Average Grain Size (μm) of Primary Crystal Si | Number of Primary Crystal Si Grains of At Least 20 μm (per $mm^2$) |
|---|---|---|---|
| Examples | 1 | 6.1 | 12 |
| | 2 | 5.8 | 0 |
| | 3 | 6 | 7 |
| Comparative Examples | 1 | 9.7 | 112 |
| | 2 | no primary crystal Si | 0 |
| | 3 | 6.4 | 62 |
| | 4 | 7.1 | 34 |
| | 5 | 6.9 | 26 |

(Wear Tests)

Wear test pieces obtained by the above procedures were used in a ring-on-plate type wear tester to perform a wear test. The conditions of the test are shown in Table 2, and the results are shown in Table 4.

TABLE 3

| | |
|---|---|
| Peripheral Velocity | 4.0 m/s |
| Contact Surface Pressure | 22 MPa |
| Lubricant | SAE 7.5W-30 (containing 1 vol % of alumina grains of average grain size 0.8 μm) |
| Lubricant Temperature | 80° C. |
| Aluminum Alloy Test Piece Shape | 35 × 35 × 6 |
| Aluminum Alloy Test Piece Surface Roughness | Ra 2.5 |
| Counterpart Piece | Chrome-plated S45C |
| Counterpart Piece Shape | Outer Diameter ϕ 25.6 mm<br>Inner Diameter ϕ 20.0 mm<br>Height 25.0 mm |
| Counterpart Piece Surface Roughness | Ra 0.8 |
| Test Time | 40 h |

TABLE 4

| Constituents | | Wear of Aluminum Alloy (μm) | Wear of Cr Plating (μm) |
|---|---|---|---|
| Examples | 1 | 7 | 3.0 |
| | 2 | 9 | 2.4 |
| | 3 | 5 | 3.4 |
| Comparative Examples | 1 | 5 | 18.0 |
| | 2 | 121 | 6.4 |
| | 3 | 22 | 13.1 |
| | 4 | 45 | 7.8 |
| | 5 | 57 | 5.1 |

As is clear from the results shown in Table 4, Examples 1-3 which are aluminum alloys according to the present invention they can be seen to exhibit reductions in the wear of the aluminum alloy itself and the wear of the counterpart piece as compared with the Comparative Examples 1-5.

In contrast, Comparative Examples 1 and 3 containing large amounts of primary crystal Si with grain sizes of at least 20 μm caused a lot of wear on the counterpart pieces (Comparative Example 1 contained a lot of Si and therefore a lot of primary crystal Si, and Comparative Example 3 contained little P and a lot of Mn and therefore had a lot of primary crystal Si). Additionally, Comparative Example 2 did not have primary crystal Si, so had a lot of wear in the aluminum alloy. Furthermore, Comparative Examples 4 and 5 had little Si expended as Al—Si—Fe—Mn—Cr compounds, so more Si forming primary crystal Si and therefore more primary crystal Si with a grain size of at least 20 μm, but the overall amount of the hard phase was less than the alloys of the present invention and the state of dispersion was also not uniform, so that the amount of wear on the aluminum alloy and the amount of wear on the counterpart piece were both greater than in the case of the present invention.

What is claimed is:

1. A die cast aluminum alloy sliding member excelling in wear resistance, consisting of:

12.0-14.0 mass % of Si;

2.0-5.0 mass % of Cu;

0.1-1.0 mass % of Mg;

0.9-1.3 mass % of Mn;

0.10-0.5 mass % of Cr;

0.05-0.20 mass % of Ti;

0.5-1.3 mass % of Fe;

0.003-0.02 mass % of P; and a remainder of Al and unavoidable impurities;

wherein:

a Ca content is limited to less than 0.005 mass %; and the alloy includes less than 20/$mm^2$ of primary crystal Si grains with a grain size of at least 20 μm at a depth of 1.5 mm from the cast surface.

2. A die cast aluminum alloy sliding member excelling in wear resistance, consisting of:

12.0-14.0 mass % of Si;

2.0-5.0 mass % of Cu;

0.1-1.0 mass % of Mg;

1.1-1.3 mass % of Mn;

0.10-0.5 mass % of Cr;

0.05-0.20 mass % of Ti;

0.5-1.3 mass % of Fe;

0.003-0.02 mass % of P; and a remainder of Al and unavoidable impurities;

wherein:

a Ca content is limited to less than 0.005 mass %; and the alloy includes less than 20/mm$^2$ of primary crystal Si grains with a grain size of at least 20 μm at a depth of 1.5 mm from the cast surface.

3. An aluminum alloy excelling in wear resistance, consisting of:

12.0-14.0 mass % of Si;

2.0-5.0 mass % of Cu;

0.1-1.0 mass % of Mg;

1.1-1.3 mass % of Mn;

0.10-0.5 mass % of Cr;

0.05-0.20 mass % of Ti;

0.5-1.3 mass % of Fe;

0.003-0.02 mass % of P; and a remainder of Al and unavoidable impurities;

wherein:

a Ca content is limited to less than 0.005 mass %; and the alloy includes less than 20/mm$^2$ of primary crystal Si grains with a size of at least 20 μm.

* * * * *